US005415475A

United States Patent [19]

Sandy

[11] Patent Number: 5,415,475

[45] Date of Patent: May 16, 1995

[54] DISPOSABLE CONTAINERS

[76] Inventor: Alan F. Sandy, 1 Old Blundells Ct., Tiverton, Devon EX16 4LF, Great Britain

[21] Appl. No.: 938,180

[22] PCT Filed: Apr. 18, 1991

[86] PCT No.: PCT/GB91/00608

§ 371 Date: Nov. 25, 1992

§ 102(e) Date: Nov. 25, 1992

[87] PCT Pub. No.: WO91/16877

PCT Pub. Date: Nov. 14, 1991

[30] Foreign Application Priority Data

Apr. 30, 1990 [GB] United Kingdom ..... 9009685

[51] Int. Cl.[6] ..... B65D 33/10

[52] U.S. Cl. ..... 383/8; 4/484; 206/204; 383/77; 383/121

[58] Field of Search ..... 4/484; 383/8, 71, 77, 383/121; 206/204

[56] References Cited

U.S. PATENT DOCUMENTS

| | | | |
|---|---|---|---|
| 2,315,390 | 3/1943 | Billeb . | |
| 3,683,426 | 8/1972 | Lagstrom | 4/484 |
| 3,920,179 | 11/1975 | Hall . | |
| 4,159,549 | 7/1979 | Layton . | |
| 4,753,538 | 6/1988 | Jorda | 383/8 |
| 4,764,029 | 8/1988 | Abblett | 383/71 X |

FOREIGN PATENT DOCUMENTS

| | | |
|---|---|---|
| 2529529 | 2/1983 | France . |
| 2190651 | 11/1987 | United Kingdom . |
| WO8911317 | 11/1989 | WIPO . |

*Primary Examiner*—Charles E. Phillips
*Attorney, Agent, or Firm*—Christie, Parker & Hale

[57] ABSTRACT

A disposable container for holding waste liquids for disposal comprises an impermeable tube-like body containing a pad of absorbent material secured in use to the inside thereof. The body has a pair of spaced handle-like loops extending from the rim of the body and a pair of ties extending from the same rim at positions intermediate the loops. The ties are capable of being tied together to effect a first closing action on the bag and the loops being capable of being tied together to effect a second closing action on said bag.

4 Claims, 2 Drawing Sheets

DISPOSABLE CONTAINERS

The present invention relates to disposable containers for receiving liquid waste material and for disposing of it in a safe manner.

Sick bags for aircraft and plastic liners for children's portable potties generally suffer from the disadvantage that when filled with a liquid waste it is difficult to dispose of the container without spillage.

It is an object of the invention to provide an improved disposable container.

According to the present invention there is provided a disposable container for holding waste liquids for disposal, said container comprising an impermeable bag-like body which when in use contains absorbent material secured to the inside thereof, a pair of spaced handle-like loops extending from the rim of said body and a pair of ties extending from said rim at positions intermediate said loops, said ties being capable of being tied together to effect a first closing action on the bag and said loops being capable of being tied together to effect a second closing action on said bag.

Disposable containers embodying the invention, will now be described, by way of example, with reference to the accompanying diagrammatic drawings in which.

Figure 1:
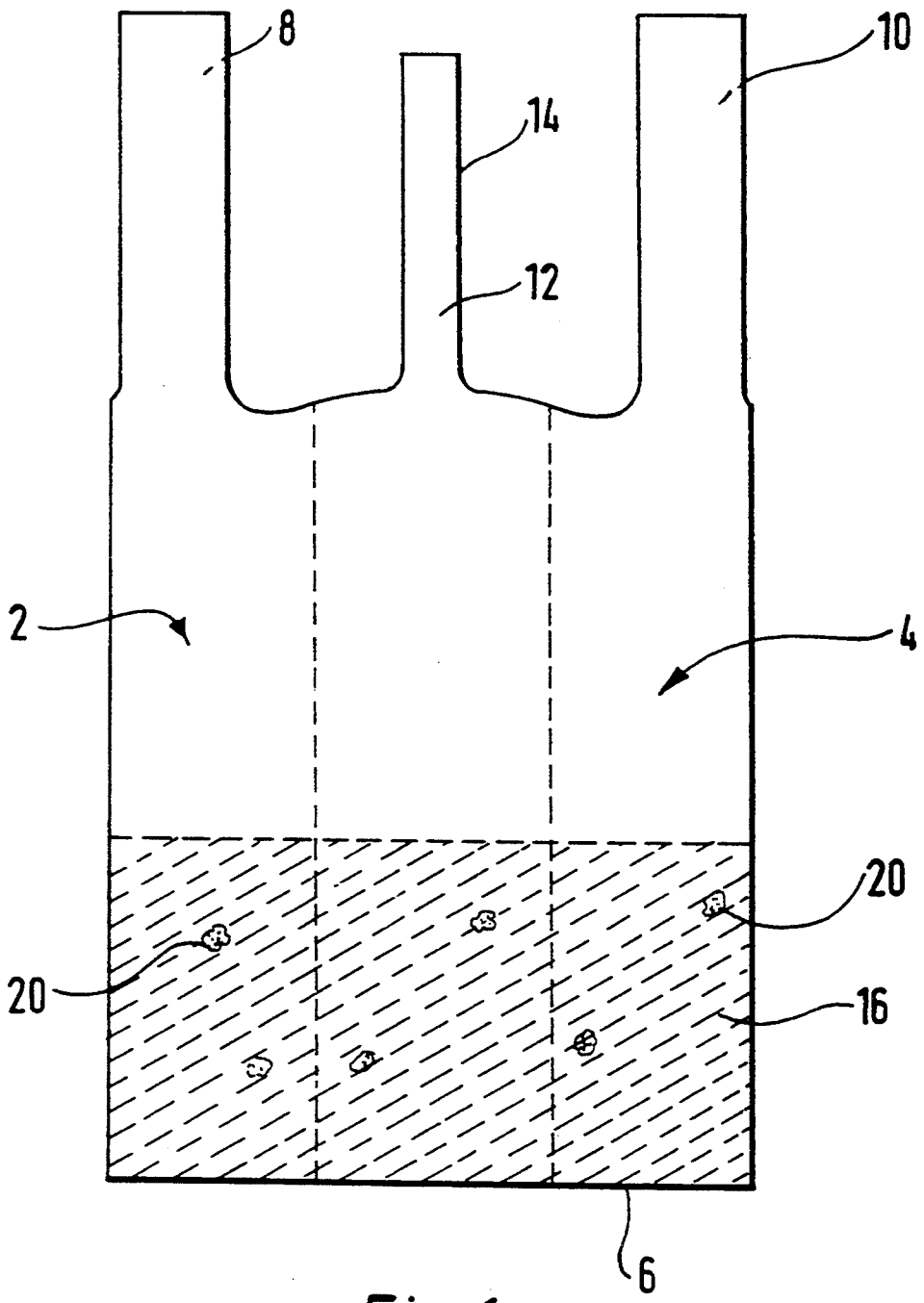
FIG. 1 is a front elevation of a first container embodying the present invention.

The disposable container or pouch shown in FIG. 1 is made of a tube of polythene with longitudinal gussets or pleats 2 and 4 formed along opposite sides. The inner most extent of each gussett is shown dotted. The lower end 6 of the tube is heat sealed to close off the lower end in a water tight manner. The upper end of the tube is also sealed and a "W" shaped recess cut centrally of the upper end to leave left and right lateral loops 8 and 10 with sealed ends and with intervening ties 12 and 14 lying between the loops. The outer longitudinal sides of the loops are cut to complete the formation of the loops.

Housed within the bag-like body defined by the tube, is a pad 16 of absorbent material. The pad 16 may be of paper, high absorbtion pulp or cotton composition or of any other liquid absorbent material. The tube and/or the liner may be treated with a perfume and/or a disinfectant composition.

The pad is secured in place by spot glueing 20 or other means well known to persons of ordinary skill.

Placing the pad 16 into the bag-like body may present problems if mass production processes are used.

Figure 2:
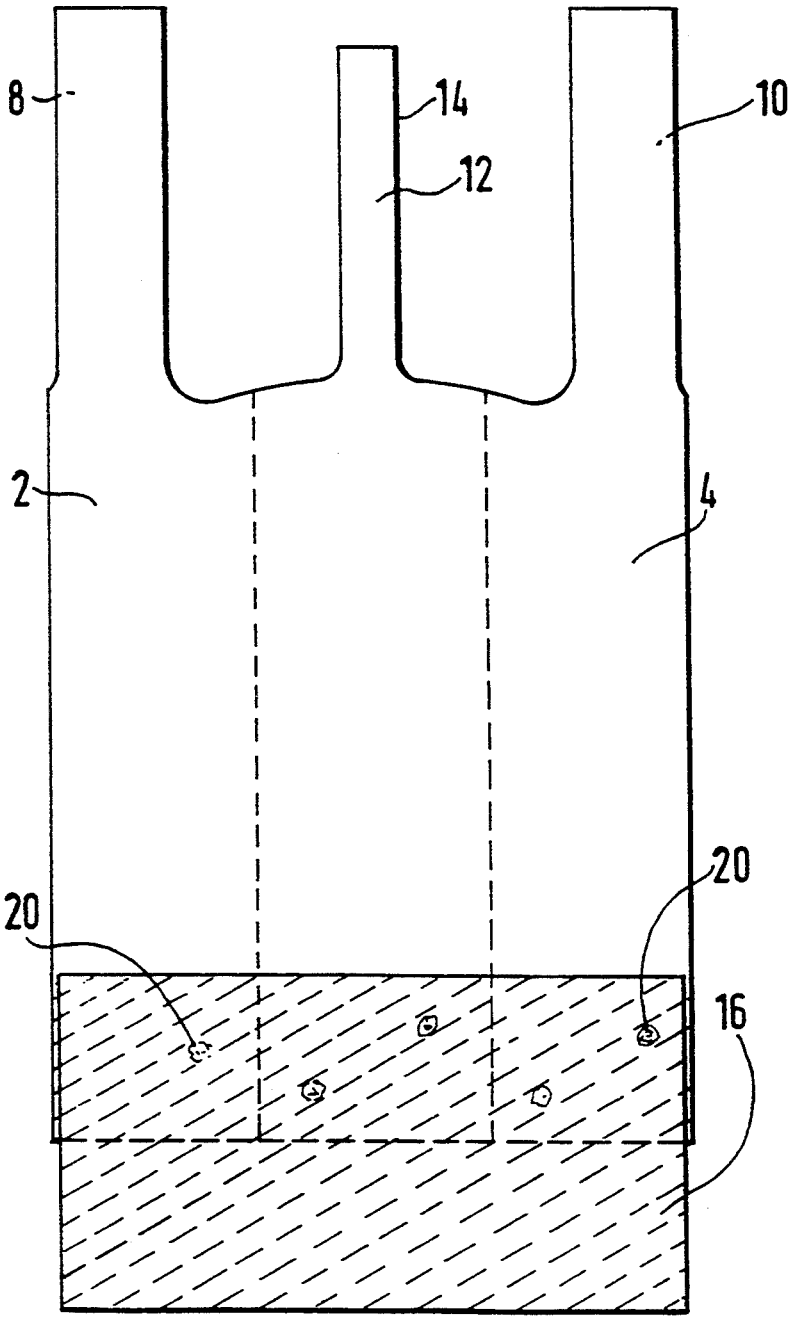
FIG. 2 is a front elevation of a second container embodying the invention immediately after manufacture but prior to inversion into a ready-for-use state.
Figure 3:
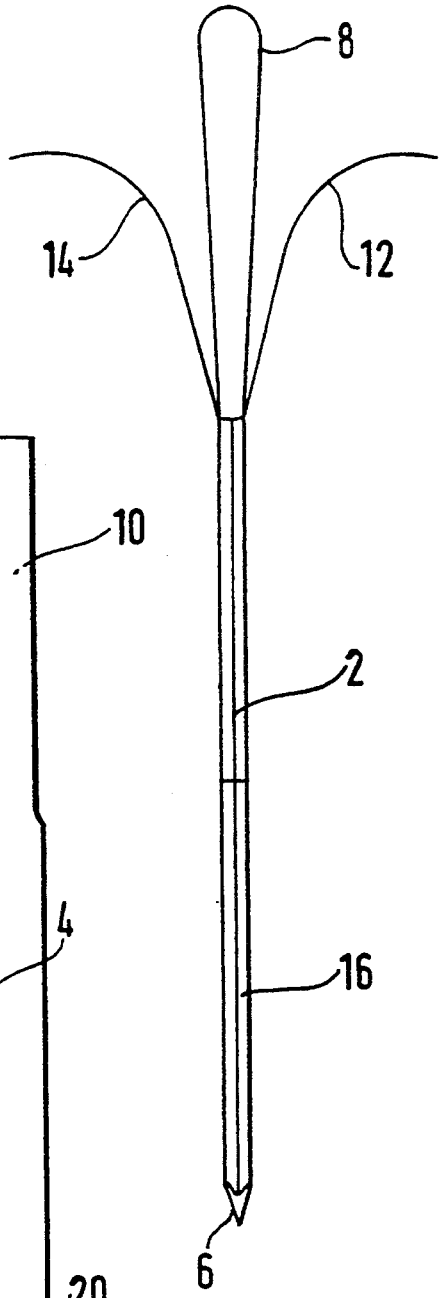
FIG. 3 is a side elevation of the container for FIG. 1 with the loops slightly opened out and the ties turned down for purposes of illustration.

In this event the pad 16 is secured to the outside of the tube as shown in FIG. 2 with approximately half of the pad projecting beyond the lower sealed end of the tube. Prior to use the bag-like body formed by the tube is inverted (turned inside out) and the pad folded in half so that it now nests inside the lower portion of the bag-like body. The container is now ready for use.

In operation the loops are used to open out the rim of the bag-like body, and to hold it ready for use. When liquid waste has been deposited in the container, the absorbent material acts to soak up the liquid.

To dispose of the container, the two ties 12 and 14 are knotted together to draw the adjacent parts of the rim together. The two loops 8 and 10 are then knotted together to bring the adjacent parts of the rim together. The double knotting action assists in securing the pad and the waste material within the body-like bag and so the container can now be safely disposed of in a dustbin or garbage can.

In a modification it will be appreciated that instead of using a pad in the body-like bag, the tubular material itself may be made of a multilayer material in which the outer layer is of impermeable material and the inner layer is of an absorbent material. Instead, the inner face of the bag-like body may be sprayed with adhesively coated particles or fragments of absorbent material so that the inner face of the body bears an absorbent lining.

I claim:

1. A disposable container for holding waste liquids for disposal, said container comprising:

an impermeable bag comprising a tube-like body having a sealed end and an open end;

a pad of liquid absorbent material secured to an exterior surface of said tube-like body adjacent said sealed end such that approximately one-half of said pad projects beyond said sealed end, said pad being of such a size that upon inversion of said exterior surface to serve as an interior surface said pad will assume a position inside of said bag at said sealed end;

a pair of spaced handle-like loops extending from the open end of said tube-like body; and a pair of ties extending from said tube-like body at said open end at positions intermediate said loops, said ties being capable of being tied together to effect a first closing action on the tube-like body and said loops being capable of being tied together to effect a second closing action on said tube-like body.

2. A container according to claim 1 wherein the pad is spot glued to the tube-like body.

3. A container according to claim 1 wherein the tube-like body is produced from a tubular member folded to effect longitudinal pleats along opposite sides of the tubular member and sealed at one end.

4. A container according to claim 1 wherein the tube-like body comprises polythene and the absorbent material comprises paper.

* * * * *